US006524040B1

(12) United States Patent
Heil

(10) Patent No.: US 6,524,040 B1
(45) Date of Patent: Feb. 25, 2003

(54) PALLET WITH SECURING MECHANISM FOR WHEELED ITEMS

(75) Inventor: Julius F. Heil, Sharpsburg, GA (US)

(73) Assignee: Burnham Service Company, Inc. (US)

( * ) Notice: Subject to any disclaimer, the term of this patent is extended or adjusted under 35 U.S.C. 154(b) by 0 days.

(21) Appl. No.: 09/516,124

(22) Filed: Mar. 1, 2000

(51) Int. Cl.[7] ..... B60P 7/08

(52) U.S. Cl. ..... 410/67; 410/34; 410/35; 410/66; 410/80; 410/100; 410/96

(58) Field of Search ..... 410/34, 35, 66, 410/67, 80, 96, 97, 100; 108/55.1, 55.3, 55.5; 248/346.01, 346.02, 346.03

(56) References Cited

U.S. PATENT DOCUMENTS

| | | | | |
|---|---|---|---|---|
| 2,315,196 A | | 3/1943 | Gallione | |
| 2,351,314 A | * | 6/1944 | Ario | 410/67 |
| 2,623,760 A | | 12/1952 | Fornelius | |
| 2,674,466 A | * | 4/1954 | Robb | 410/67 |
| 2,696,360 A | * | 12/1954 | Toffolon | 410/97 X |
| 2,950,126 A | * | 8/1960 | Armentrout | 410/66 |
| 3,478,995 A | | 11/1969 | Lautzenhiser et al. | |
| 3,620,388 A | | 11/1971 | Mansson | |
| 3,658,195 A | | 4/1972 | Fantin | |
| 3,665,869 A | | 5/1972 | Howe | |
| 3,675,595 A | | 7/1972 | Sullivan | |
| 3,753,407 A | | 8/1973 | Tilseth | |
| 3,833,138 A | | 9/1974 | Dean | |
| 4,056,066 A | * | 11/1977 | Homanick | 410/66 |
| 4,129,927 A | | 12/1978 | Anderson | |
| 4,216,568 A | | 8/1980 | Anderson | |
| 4,266,756 A | | 5/1981 | Anderson | |
| 4,295,431 A | | 10/1981 | Stavlo | |
| 4,799,840 A | * | 1/1989 | Van Gompel et al. | 410/35 X |
| 4,804,087 A | | 2/1989 | Smith | |

(List continued on next page.)

FOREIGN PATENT DOCUMENTS

| | | |
|---|---|---|
| DE | G 81 10 297.6 | 9/1981 |
| DE | 204 894 | 12/1983 |
| DE | G 82 27 248.4 | 3/1984 |
| DE | G 94 00 050.6 | 5/1994 |

(List continued on next page.)

OTHER PUBLICATIONS

Perstorp Xytec, Inc., *AgBin Collapsible Containers for Agriculture: AgBin Collapsible Plastic Containers Improve Produce Quality, Reduce Operating Cost*, 1995, 2 pages.

Litco International, Inc., *Litco Product Information—Nestable Plastic Pallets*, 1991, 2 pages.

*Primary Examiner*—Stephen T. Gordon
(74) *Attorney, Agent, or Firm*—Sutherland Asbill & Brennan LLP

(57) ABSTRACT

A pallet for wheeled items comprises a base frame, a platform on the base frame, a first plurality of ramps on the base frame and sloping from the platform toward the base and a first end of the base frame, and a second plurality of ramps on the base frame and sloping from the platform toward the base frame and a second end of the base frame. The support, the first plurality of ramps, and the second plurality of ramps are structured and arranged so that when the first wheeled item is shifted on its wheels from the support surface along the first plurality of ramps and a second of the wheeled items is shifted on its wheels along the support surface along the second plurality of ramps, the undercarriages of the first and second wheeled items move toward the platform and the wheels of the item nest into the platform. Systems for securing items to the pallet including brackets and strapping mechanisms are also disclosed.

15 Claims, 4 Drawing Sheets

U.S. PATENT DOCUMENTS

| | | | | | |
|---|---|---|---|---|---|
| 4,829,909 | A | | 5/1989 | Mandel | |
| 4,886,694 | A | | 12/1989 | Donnard | |
| 4,911,084 | A | | 3/1990 | Sato et al. | |
| 4,929,133 | A | * | 5/1990 | Wiseman | 410/67 X |
| 5,097,951 | A | | 3/1992 | Pigott et al. | |
| 5,147,145 | A | | 9/1992 | Facey et al. | |
| 5,170,721 | A | | 12/1992 | Troth et al. | |
| 5,423,428 | A | | 6/1995 | Selz | |
| 5,505,140 | A | | 4/1996 | Wittmann | |
| 5,579,700 | A | | 12/1996 | Nuechterlein et al. | |
| 5,651,463 | A | | 7/1997 | Major et al. | |
| 5,772,369 | A | * | 6/1998 | Lerman et al. | 410/96 |
| 5,787,817 | A | | 8/1998 | Heil | |
| 5,911,179 | A | | 6/1999 | Spiczka | |
| 5,970,885 | A | * | 10/1999 | Polardo | 108/55.3 |
| 6,006,675 | A | | 12/1999 | Heil | |
| 6,006,676 | A | | 12/1999 | Creek et al. | |
| 6,035,790 | A | * | 3/2000 | Polardo | 108/55.1 |
| 6,065,916 | A | * | 5/2000 | Swensen | 410/97 |
| 6,126,131 | A | * | 10/2000 | Tietz | 248/346.01 |

FOREIGN PATENT DOCUMENTS

| | | | |
|---|---|---|---|
| EP | 0 785 144 | A1 | 7/1997 |
| FR | 2106986 | | 9/1970 |
| FR | 2446239 | | 1/1979 |
| GB | 1 361 066 | | 7/1974 |
| GB | 2 210 517 | A | 6/1989 |
| GB | 2 240 581 | A | 8/1991 |
| GB | 2 247 899 | A | 3/1992 |
| GB | 2 247 926 | A | 3/1992 |
| GB | 2 248 283 | A | 4/1992 |
| GB | 2 322 408 | A | 8/1998 |
| GB | 2 322 435 | A | 8/1998 |
| JP | 1-9157 | A | 12/1989 |
| WO | WO 91/04137 | | 4/1991 |
| WO | WO 95/30844 | | 11/1995 |
| WO | WO 97/36123 | | 10/1997 |
| WO | WO 98/05564 | | 2/1998 |
| WO | WO 99/58408 | | 11/1999 |
| WO | WO 00/73160 | | 7/2000 |

* cited by examiner

PALLET WITH SECURING MECHANISM FOR WHEELED ITEMS

TECHNICAL FIELD

This pallet relates to pallets for storing items on wheels such as casters.

BACKGROUND OF THE INVENTION

Goods are often effectively and efficiently stored and transported in stacked configuration. Stacking goods maximizes the use of available storage and transportation space. In addition, manipulating such goods with a forklift for quick handling of the goods saves labor and time. Some goods, however, are difficult to store and transport in stacked configuration and are not easily manipulated with a forklift. Wheeled items, such as photocopiers or computers on casters are an example of such goods which are difficult to handle. Typically, an item such as a photocopier or computer on casters has to be placed on skids and secured to the skids to be manipulated with a forklift and stored and transported in stacked configuration. Such wheeled items must be carefully secured to the skids so that the wheeled items do not roll on the pallet and shift during storage and transportation. This is a time consuming task.

Alternatively, wheeled items can be stored on an open floor without stacking the items; however, this occupies a large space. In addition, when wheeled items are unsecured to skids, they are difficult to manipulate with a forklift. This method is also very time consuming.

Wheeled items sometimes are stored in sets such as when a large computer and an accompanying frame are both on casters. Storing both such items on the same skids or pallets magnifies the problems described above.

Therefore, there is a need for a system for storing and transporting wheeled items, and even sets of wheeled items, in a manner that allows stacking of the items and their manipulation with a forklift.

SUMMARY OF THE INVENTION

The present invention solves the above described problems in the prior art by providing a pallet comprising ramps for handling wheeled items and systems for securing the wheeled items to the pallet such that the items nest in the pallet and are held on the pallet.

According to one aspect of this invention, a pallet is provided for storing and transporting at least a pair of wheeled items. Each wheeled item comprises an undercarriage and wheels extending from the undercarriage. The pallet comprises a base frame extending from a first end to a second end, a platform on the base frame and having a support surface for receiving the wheels of the items, a first plurality of ramps on the base frame, and a second plurality of ramps on the base frame. The first plurality of ramps slope from the platform toward the base frame and the first end of the base frame. The second plurality of ramps slopes from the platform toward the base frame and the second end of the base frame. The support, the first plurality of ramps, and the second plurality of ramps are structured and arranged so that when a first of the wheeled items is shifted on its wheels from the support surface along the first plurality of ramps and a second of the wheeled items is shifted on its wheels from the support surface along the second plurality of ramps, the undercarriages of the first and second wheeled items move toward the platform and the wheels of the items nest into the platform. This allows the pair of wheeled items to be loaded from opposite ends of the pallet and be secured within the pallet platform. Desirably, the first and second plurality of ramps each slope within recesses in the platform. Each recess comprises and end wall and side walls extending upwardly from the base frame. The wheels of the items can be securely anchored within the recesses.

More particularly, the pallet of this invention for at least a pair of wheeled items comprises a bracket mounted to the pallet proximate one of the first plurality of ramps. The bracket is structured and arranged so that when the first wheeled item is shifted on the wheels from the support surface along the plurality of ramps, the bracket receives a stem of one of the wheels of the first wheeled item. Desirably, the pallet comprises a plurality of such brackets so that the brackets receive respective stems of the wheels when the first wheeled item is loaded onto the pallet and shifted down the respective ramps.

The pallet of this invention for transporting at least a pair of wheeled items desirably also comprises a strapping mechanism mounted to the pallet. The strapping mechanism comprises a plurality of attachments for attachment to respective stems of the wheels of the first wheeled item and a selectively releasable tightening mechanism for drawing the attachments and securing the wheels of the first wheeled item within the respective ones of the first plurality of ramps and securing the wheeled item against the pallet. Suitable tightening mechanisms include a selectively releasable buckle or ratchet. Desirably, the strapping mechanism includes a strap connected to a plurality of attachments and the tightening mechanism draws the attachments with the strap.

According to a particular embodiment of this invention, a pallet for transporting a pair of wheeled items includes a bracket or plurality of brackets as described above and the strapping mechanism as described above. The strapping mechanism is useful for drawing the wheeled item such that the wheel stems are secured within the bracket or brackets. More particularly, the pallet can be arranged so that a plurality of brackets are mounted to the pallet to receive stems of one set of wheels on the wheeled item and the strapping mechanism attaches to stems of another set of wheels and the strapping mechanism draws wheels of the items against the brackets and the wheeled item against the pallet.

This invention also encompasses a pallet for storing one or more wheeled items comprising a plurality of ramps and one or more brackets as described above. Another embodiment encompassed by this invention is a pallet for one or more wheeled items comprising a plurality of ramps and a strapping mechanism as described above.

Still another embodiment encompassed by this invention is a pallet for one or more wheeled items comprising a plurality of ramps and first and second sets of brackets for receiving the stems of wheels of the item being stored. Desirably, one of the sets of bracket is pivotally mounted to the pallet so that the pivotable brackets can be positioned about wheel stems of the wheeled item after the item is loaded onto the pallet.

Other objects, features and advantages of this invention will become apparent from the following detailed description, drawings and claims.

DETAILED DESCRIPTION OF EMBODIMENTS

Figure 1:
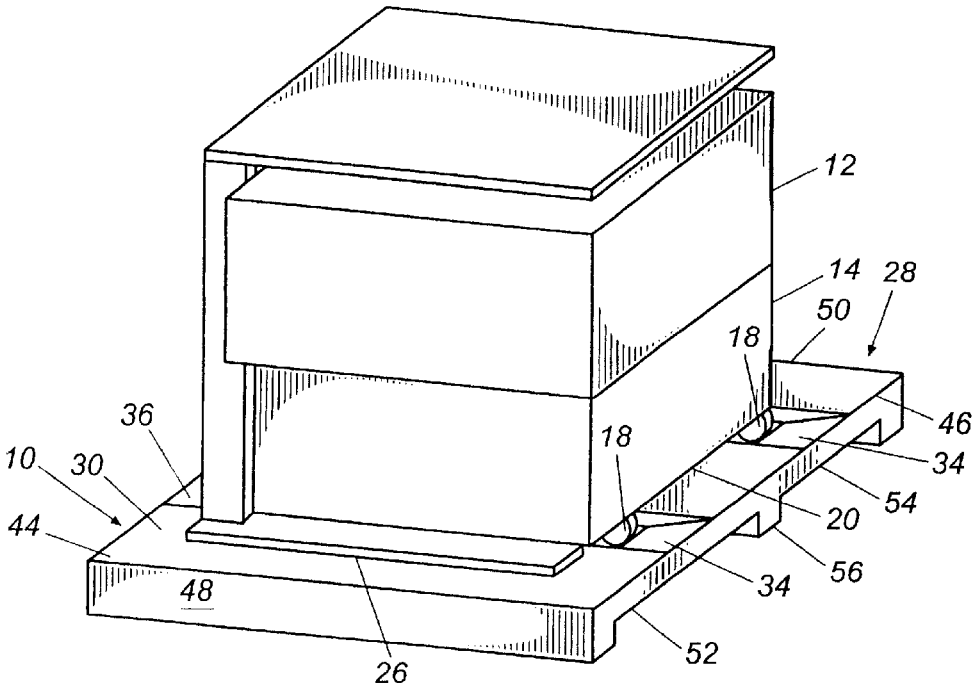
FIG. 1 is a perspective view of a pallet made according to an embodiment of this invention loaded with two wheeled items, a computer processing unit and an external frame.

Turning now to the drawing in which like numerals reference like parts throughout the several views, a pallet 10 is shown for storing a pair of wheeled items including a first wheeled item 12, such as a computer, and a second wheeled item 14, such as an external frame. The first wheeled item 12 includes rear and front casters 16 and 18 extending beneath an undercarriage 20. Likewise, the second wheeled item 14 includes rear and front casters 22 and 24 extending from an undercarriage 26. This is best illustrated in FIG. 1.

Generally described, the pallet 10 includes a base frame 28, a platform 30 supported by the base frame, a first plurality of ramps 32 and 34 for receiving the casters 16 and 18 of the first wheeled item 12, a second plurality of ramps 36 and 38 for receiving the casters 22 and 24 of the second wheeled item 14, a pair fixed of brackets 40 mounted to the platform proximate a pair 32 of the first plurality of ramps, and a strapping mechanism 42 for securing the first wheeled item to the pallet.

The pallet 10 can be made of a variety of materials provided that the pallet can withstand the weight of the wheeled items 12 and 14 and repeated handling such as with a forklift. Therefore, suitable materials for making the pallet include wood, metal, and polymer resins such as plastic. Polymner resin is particularly desirable for forming the pallet 10 because many polymer resins are strong, durable, lightweight and relatively inexpensive. In addition, many polymer resins can be injection molded. Injection molding is a desirable method of making the pallet 10 and a particularly suitable resin is high density polyethylene.

Figure 3:
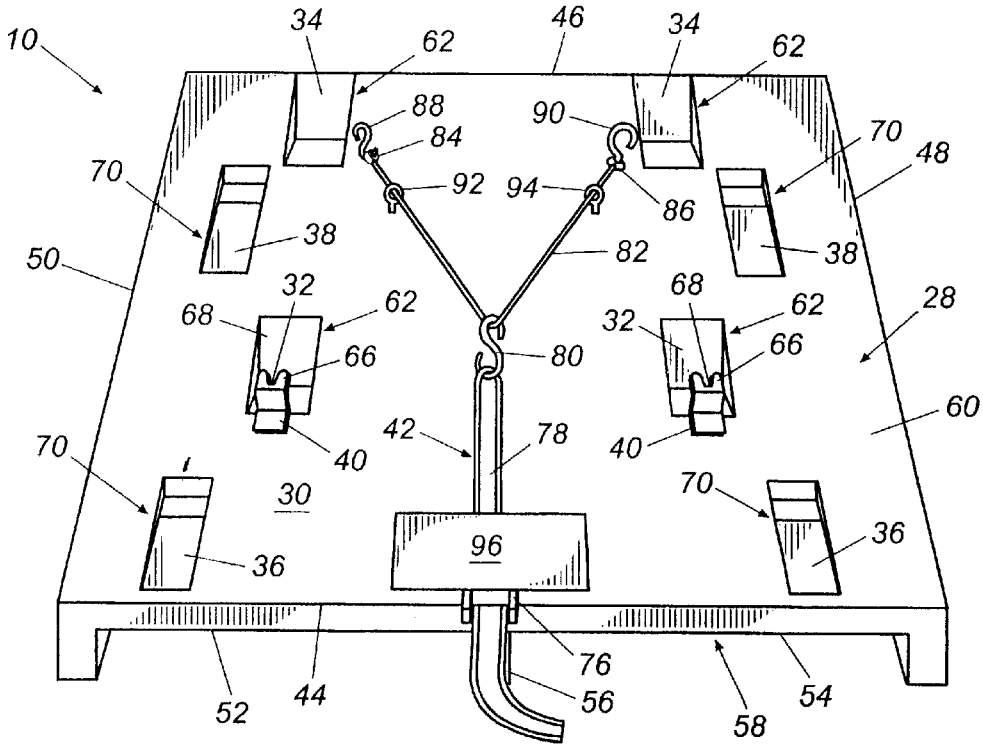
FIG. 3 is an end perspective view of the pallet illustrated in FIG. 1.
Figure 2:
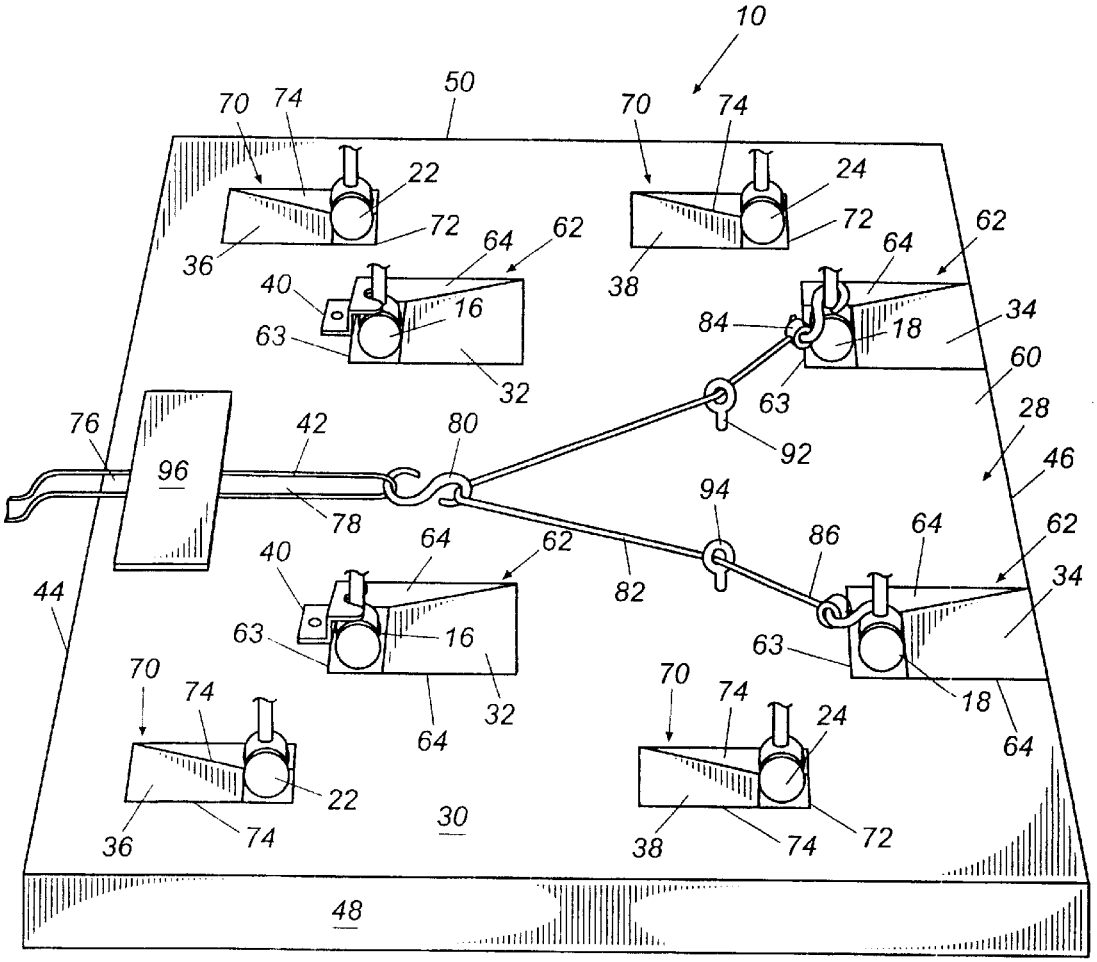
FIG. 2 is a side perspective view of the pallet illustrated in FIG. 1.

As best shown in FIGS. 2 and 3, the base frame 28 of the pallet 10 is substantially rectangular in shape and extends form a first end 44 to a second end 46 along a longitudinal axis and has respective first and second side walls 48 and 50 extending between the first and second ends. In addition, the base frame 28 has a pair of forklift openings 52 and 54 extending from the first end 44 of the base frame to the second end 46 of the base frame so that the pallet 10 can be manipulated with a forklift. The forklift openings 50 and 52 are separated by a middle support 56. The forklift openings 52 and 54 and the middle support 56 form part of an underside 58 of the base frame 28. The underside 58 of the base frame 28 faces downwardly and rests on the floor when the pallet 10 is being used for loading and storing items. The base frame 28 extends from the underside 58 upwardly to the platform 30 which has a support surface for receiving the casters 16, 18, 22, and 24 of the first and second wheeled items 12 and 14.

The first plurality of ramps include a pair 32 of ramps for receiving the rear casters 16 and a pair 34 of ramps for receiving the front casters 18 of the first wheeled item. The first plurality of ramps 32 and 34 are arranged in a square pattern to match the pattern of the front and rear casters 16 and 18 of the first wheeled item 12. The first plurality of ramps 32 and 34 slope from the platform 30 toward the base frame 28 and the first end 44 of the base frame and extend substantially parallel to the longitudinal axis of the pallet 10. The first plurality of ramps 32 and 34 slope within recesses 62 in the platform 30. Each of the recesses 62 comprise an end wall 63 and side walls 64 extending upwardly from the base frame 28 to the support surface 60. When the first wheeled item 12 is loaded onto the pallet 10, the rear and front casters 16 and 18 travel down the first plurality of ramps 32 and 34 and nest into the platform 30 within the recesses 62.

The brackets 40 are fixed to the platform 30 proximate the end walls 63 of the pair 32 of the first plurality of ramps which receive the rear casters 18 of the first wheeled item 12. The brackets 40 extend upwardly and include fingers 66 extending toward the adjacent ramp. The fingers 66 are spaced from one another and form a port 68 therebetween for receiving the stem of the respective rear casters 16 of the first wheeled item 12.

The second plurality of ramps 36 and 38 slope from the platform 30 toward the base frame 28 and the second end 46 of the base frame. In other words, the second plurality of ramps 36 and 38 extend in a direction substantially opposite the first plurality of ramps 32 and 34. The second plurality of ramps 36 and 38 are configured to receive the rear and front casters 22 and 24 of the second wheeled item 14, which is an external frame. The second plurality of ramps 36 and 38 are configured so that the first wheeled item 12 fits within the second wheeled item 14 when the items are loaded on the pallet 10.

The second plurality of ramps also slope within recesses 70 in the platform 30. Each of these recesses 70 comprises an end wall 72 and side walls 74 extending upwardly from the base frame 28. Therefore, when the casters 22 and 24 of the second wheeled 14 are moved down the second plurality of ramps 36 and 38, the casters of the second wheeled item nest into the platform 30 within the recesses 70.

The strapping mechanism 42 comprises a selectively releasable buckle or ratchet 76 mounted within the platform 30 of the pallet 10 proximate the second end 46 of the base frame 28. The strapping mechanism 42 also includes a first strap 78 fed through the buckle or ratchet 76 and extending from the buckle or ratchet 76 to an attachment such as a hook 80. A second strap, such as a wire rope 82, extends from the hook 80 towards opposite ends 84 and 86. The ends 84 and 86 or the wire rope 82 are connected to attachments such as hooks 88 and 90. The wire rope 82 passes through the aperture of an anchor, such as eyebolts 92 and 94, proximate the pair 32 of the first plurality of ramps for receiving the front casters 24 of the first wheeled item 12. The hooks 88 and 90 at the ends 84 and 86 of the wire rope 82 can be wrapped around respective stems of the front casters 24 of the first wheeled item 12. The first strap 78 of the strapping mechanism 42 can then be pulled taut so that the first wheeled item 12 is pulled against the brackets 40 and downwardly to secure the first wheeled item to the pallet.

A cover plate 96 fits over the releasable buckle or ratchet 76 for protection. The wheeled items 12 and 14 can be easily loaded onto the pallet 10 and secured by covering the pair 32 of the first plurality of ramps for receiving the front casters 18 of the first wheeled item with a plate or wedge (not shown) and rolling the rear casters 16 of the first wheeled item past the first set of ramps to the second set of ramps 34. The plate or wedge covering the first pair of ramps 32 are removed and the rear and front casters 16 and 18 of the first wheeled item 12 are rolled downwardly along the first plurality of ramps 32 and 34 until the stems of the rear casters 16 of the first wheeled item are received within the ports 68 in the brackets 40. The hooks 88 and 90 of the strapping mechanism 42 are then wrapped around the stems of the front casters 18 of the first wheeled item 12 and the first strap 78 of the strapping mechanism is pulled taut to force the wheeled item against the brackets and downwardly against the pallet. Lastly, the second wheeled item or external frame 14 is lifted onto the pallet and the rear and front casters 22 and 24 are rolled down the second plurality of ramps 36 and 38 until the rear and front casters are nested into the recesses 70 in the platform 30. The first and second wheeled items 12 and 14 can then be fixed to one another with straps or shrink wrap, or the like. Once loaded and secured on the pallet, the wheeled items 12 and 14 can be transported with a forklift.

The pallet 10 can be used to store and transport a variety of wheeled items such as the computer 12 and external frame 14 illustrated in FIG. 1. To accommodate the storage and transportation of different items, the pallet 10 can be any size. In addition, the pallet 10, when unloaded, is stackable. The exposed brackets 40 nest into a pallet placed above by utilizing the cavities created by the forklift openings 52 and 54.

Figure 4:
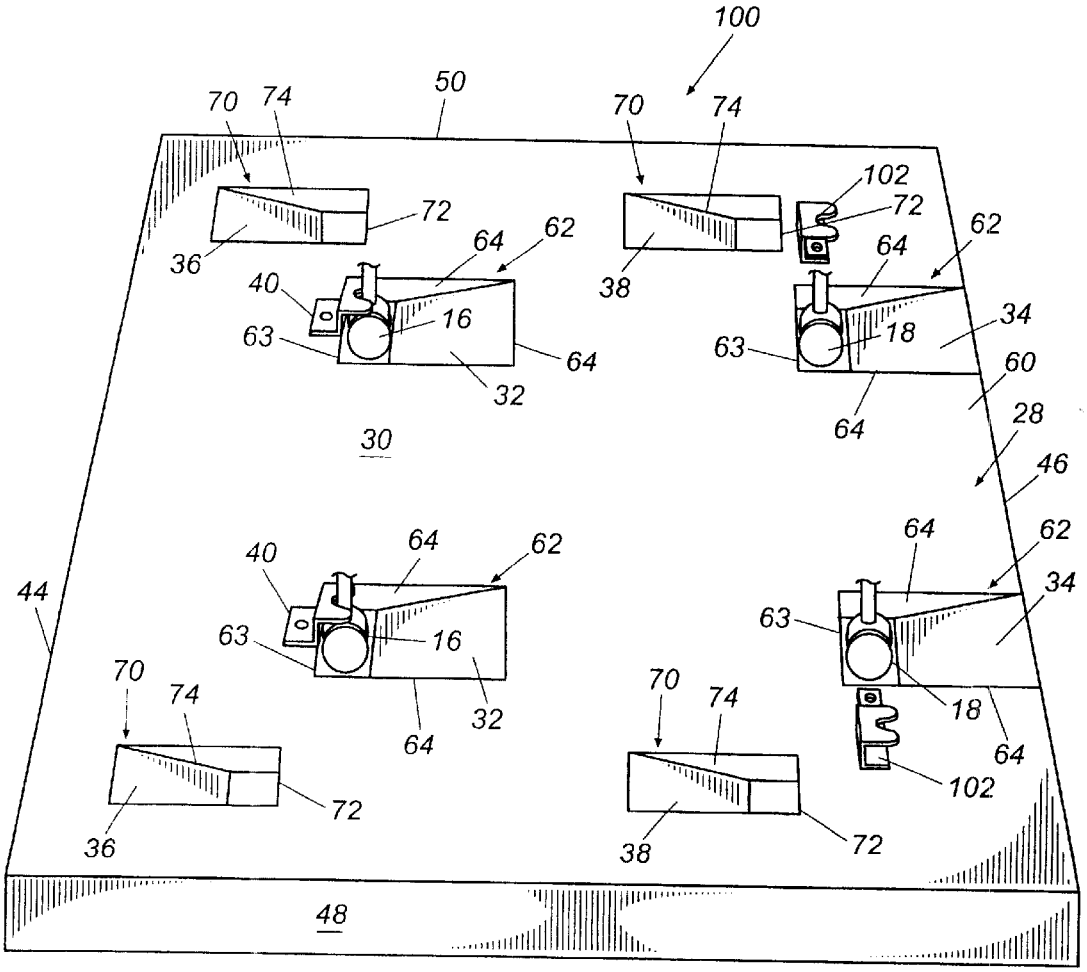
FIG. 4 is a perspective view of a pallet made in accordance with another embodiment of this invention. This pallet has pivoting brackets.

Another embodiment of this invention is illustrated in FIG. 4. This pallet 100 has the same structure as pallet 10 illustrated in FIGS. 1–3 except that the strapping mechanism 42 is replaced with a second pair of brackets 102. The brackets 102 are pivotally mounted to the platform 30 so that when after the first wheeled item 12 is loaded onto the pallet, the brackets 102 can then be pivoted until the stems of the front casters 18 of the first wheeled item fit within the brackets. The front and rear casters 16 and 18 of the first wheeled item are then secured against the pallet 100 by both pairs of brackets 40 and 102.

Figure 5:
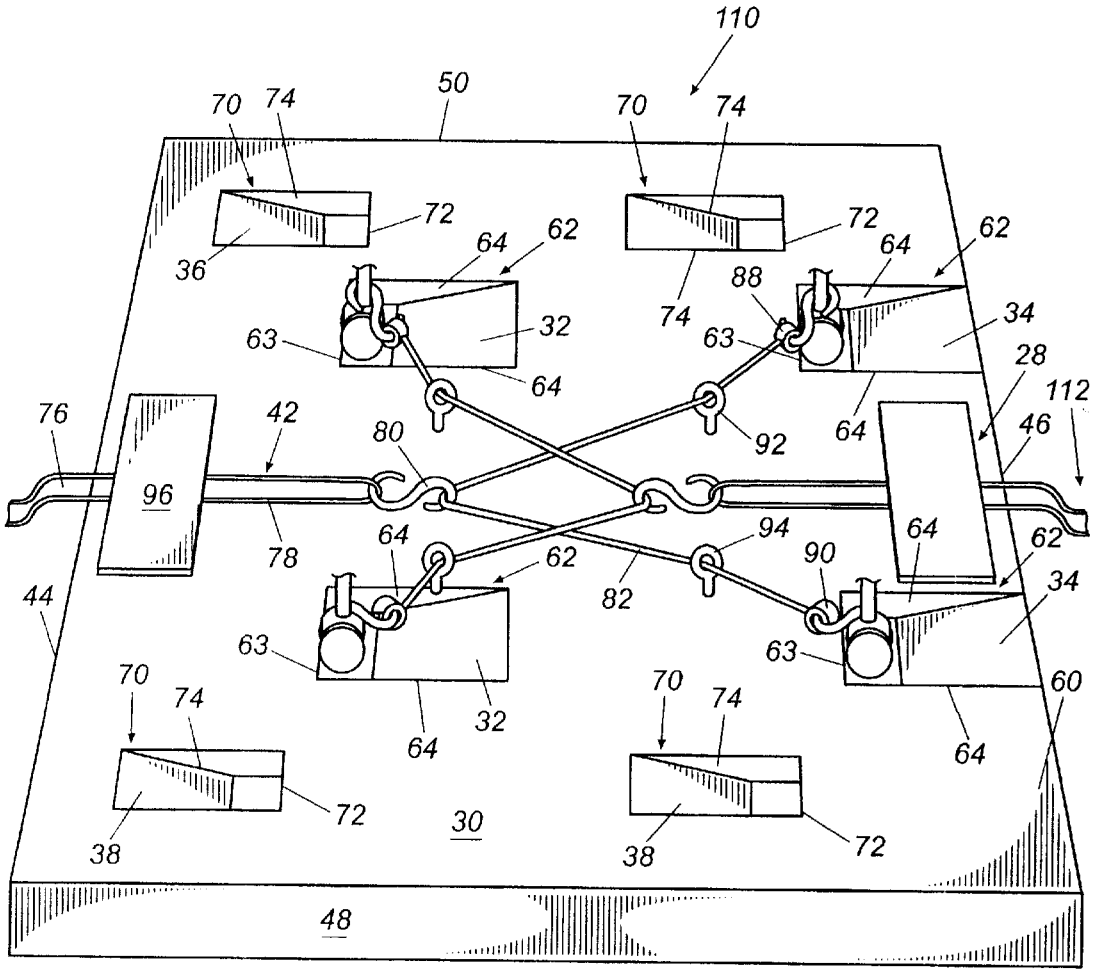
FIG. 5 is a side perspective view of a pallet made in accordance with yet another embodiment of this invention. This pallet has dual strapping mechanisms.

Still another embodiment 110 of this invention is illustrated in FIG. 5. This pallet 110 comprises a second strapping mechanism 112 which is identical to the first strapping mechanism 42 except that the second strapping mechanism extends from the opposite end 44 of the pallet and secures the rear casters 16 of the first wheeled item. The strapping mechanisms 42 and 112 are both pulled taut to secure the wheeled item 12 to the pallet.

Other strapping arrangements can be used to secure the wheeled items 12 and 14 to the pallet as will be understood by those skilled in the art. It should be understood that the foregoing relates to particular embodiments of the invention, and that numerous changes can be made therein without departing from the scope of the invention as defined by the following claims.

I claim:

1. A pallet for a pair of wheeled items, each comprising an undercarriage and wheels extending from the undercarriage and the first wheeled item having front wheels and rear wheels, the pallet comprising:

a base frame extending from a first end to a second end;

a platform on the base frame and having a support surface for receiving the wheels of the items;

a first plurality of ramps on the base frame and sloping from the platform toward the base frame and the first end;

a second plurality of ramps on the base frame and sloping from the platform toward the base frame and the second end, and a plurality of brackets including a first bracket and mounted to the pallet proximate respective ones of the first plurality of ramps receiving one set of wheels of the first wheeled item, the plurality of brackets structured and arranged so that when the first wheeled item is shifted on its wheels from the support surface along the first plurality of ramps, the plurality of brackets receive respective stems of the one set of wheels of the first wheeled item;

the platform, the first plurality of ramps, and the second plurality of ramps structured and arranged so that when a first of the wheeled items is shifted on its wheels from the support surface along the first plurality of ramps and a second of the wheeled items is shifted on its wheels from the support surface along the second plurality of ramps, the undercarriages of the first and second wheeled items move toward the platform and the wheels of the item nest into the platform.

2. A pallet for a pair of wheeled items, each comprising an undercarriage and wheels extending from the undercarriage, the pallet comprising:

a base frame extending from a first end to a second end;

a platform on the base frame and having a support surface for receiving the wheels of the items;

a first plurality of ramps on the base frame and sloping from the platform toward the base frame and the first end; and a second plurality of ramps on the base frame and sloping from the platform toward the base frame and the second end, the first and second plurality of ramps each sloping within recesses in the platform, each access comprising an end wall and side walls extending upwardly from the base frame, the platform the first plurality of ramps, and the second plurality of ramps structured and arranged so that when a first of the wheeled items is shifted on its wheels from the support surface along the first plurality of tamps and a second of the wheeled items is shifted on the wheels from the support surface along the second plurality of ramps, the undercarriage of the first and second wheeled items move toward the platform and the wheels of the item nest into the platform.

3. A pallet for a pair of wheeled items, each comprising an undercarriage and wheels extending from the undercarriage, the pallet comprising:

a base frame extending from a first end to a second end;

a platform on the base frame and having a support surface for receiving the wheels of the items;

a first plurality of ramps on the base frame and sloping from the platform toward the base frame and the first end;

a second plurality of ramps on the base frame and sloping from the platform toward the base frame and the second end; and a first bracket mounted to the pallet proximate one of the first plurality of ramps;

the platform the first plurality of ramps, and the second plurality of ramps structured and arranged so that when a first of the wheeled items is shifted on its wheels from the support surface along the first plurality of ramps, and a second of the wheeled items is shifted on the wheels from the support surface along the second plurality of ramps, the undercarriages of the first and second wheeled item move toward the platform and the wheels of the item nest into the platform, and the first bracket structured and arranged so that when the first wheeled item is shifted on the wheels from the support surface along the plurality of ramps the first bracket receives a stem of one of the wheels of the first wheeled item.

4. A pallet as in claim 3 further comprising plurality or brackets including the first bracket and mounted to the pallet proximate respective ones of the first plurality of ramps, the plurality of brackets structured and arranged so that when the first wheeled item is shifted on the wheels from the support surface along the plurality of ramps the plurality of brackets receive respective stems of the wheels of the first wheeled item.

5. A pallet as in claim 3 further comprising a second bracket pivotally mounted to the pallet proximate one of the first plurality of ramps, so that, when the first wheeled item is shifted on the wheels from the support surface along the plurality of ramps, the second bracket can be selectively pivoted into a position such that the second bracket receives a stem of one of the wheels of the first wheeled item.

6. A pallet for a pair of wheeled items, each comprising an undercarriage and wheels extending from the undercarriage, the pallet comprising:

a base frame extending from a first end to a second end;

a platform on the base frame and having a support surface for receiving the wheels of the items;

a first plurality of ramps on the base frame and sloping from the platform toward the base frame and the first end;

a second plurality of ramps on the base frame and sloping from the platform toward the base frame and the second end;

a first bracket mounted to the pallet proximate one of the first plurality of ramps, the first bracket structured and arranged so that when the first wheeled item is shifted on its wheels from the support surface along the first plurality of ramps, the first bracket receives a stem of one of the wheels of the first item; and a strapping mechanism mounted to the pallet and comprising a plurality of attachments for attachment to respective stem of the wheels of the first item, and a selectively releasable tightening mechanism for drawing the attachments and securing the wheels of the first wheeled item within the ramps, the stem of the one wheel within the bracket and the first wheeled item against the pallet;

the platform, the first plurality of ramps, and the second plurality of ramps structured and arranged so that when a first of the wheeled items is shifted on its wheels from the support surface along the first plurality of ramps and a second of the wheeled items is shifted on its wheels from the support surface along the second plurality of ramps, the undercarriages of the first and second wheeled items move toward the platform and the wheels of the item nest into the platform.

7. A pallet for a wheeled item comprising all undercarriage and wheels extending from the undercarriage the pallet comprising:

a base flame;

a platform on the base frame and having a support surface for receiving the wheels of the item; and a plurality of ramps on the base frame and sloping from the platform toward the base frame;

a first bracket mounted to the pallet proximate one of the plurality of ramps;

the platform, the plurality of ramps, and the first bracket structured and arranged so that when the wheeled item is shifted on the wheels from the support surface along the plurality of ramps, the undercarriage of the wheeled item moves toward the platform and the first bracket receives a stem of one of the wheels.

8. A pallet as in claim 7 further comprising a plurality or brackets including the first bracket and mounted to the pallet proximate respective ones of the plurality of ramps, the plurality of brackets structured and arranged so that when the wheeled item is shifted on the wheels from the support surface along the plurality of ramps, the plurality of brackets receive respective stems of the wheels.

9. A pallet as in claim 7 wherein the first bracket is pivotally mounted to the pallet proximate one of the first plurality of ramps, so that the first bracket can be selectively pivoted into a position such that when the wheeled item is shifted on the wheels from the support surface along the plurality of ramps, the first bracket receives a stem of one of the wheels.

10. A pallet as in claim 9 further comprising a strapping mechanism mounted to the pallet and comprising a plurality of attachments for attachment to respective stems of the wheels, and a selectively releasable tightening mechanism for drawing the attachments and securing wheels of the wheeled stem within the respective ones of the plurality of ramps and securing the wheeled item against the pallet.

11. A pallet as in claim 10 wherein the tightening mechanism is a ratchet.

12. A pallet as in claim 10 wherein the strapping mechanism includes a strap connected to the plurality of attachments and the tightening mechanism draws the attachments with the strap.

13. A pallet as in claim 7 wherein the first wheeled item has a first set of wheels and a second set of wheels, and the pallet further comprises:

a plurality of brackets including the first bracket and mounted to the pallet proximate respective one of the plurality of ramps receiving the first set of wheels of the wheeled item, the plurality of brackets structured and arranged so that when the wheeled item is sifted on its wheels from the support surface along the plurality of ramps, the plurality of brackets receive respective stems of the first set of wheels of the wheeled item; and a strapping mechanism mounted to the pallet and comprising a plurality of attachments for attachment to respective stems of the second set of wheels of the first item, and a selectively releasable tightening mechanism for drawing the attachments and securing the second set of wheels of the wheeled item within the ramps, the stems of the wheels of the wheeled item within the plurality of brackets, and the wheeled item against the pallet.

14. A pallet as in claim 13 wherein the plurality of ramps each slope within recesses in the platform, each recess comprising an end wall and side walls extending upwardly from the base frame such that when the wheeled item is shifted on its wheels from the support surface along the plurality of ramps, the undercarriage of the wheeled item moves toward the platform and the wheels of the item nest into the recesses in the platform.

15. A pallet for a wheeled item comprising an undercarriage and wheels extending from the undercarriage, the pallet comprising:

a base frame;

a platform on the base frame and having a support surface for receiving the wheels of the item;

a plurality of ramps on the base frame and sloping from the platform toward the base frame, the plurality of ramps each slope within recesses in the platform, each recess comprising an end wall and side walls extending upwardly from the base frame, the platform and the plurality of ramps structured and arranged so that when the wheeled item is shifted on the wheels from the support surface along the plurality of ramps, the undercarriage of the wheeled item comes moves toward the platform and the wheels of the item nest into the platform; and a strapping mechanism mounted to the pallet and comprising a plurality of attachments for attachment to respective stems of the wheels, and a selectively releasable tighting mechanism for drawing the attachments and securing the wheels of the item within the ramps and the wheeled item against the pallet.

* * * * *